US009581968B2

(12) United States Patent
Hiranuma et al.

(10) Patent No.: US 9,581,968 B2
(45) Date of Patent: Feb. 28, 2017

(54) TIMEPIECE

(71) Applicant: Seiko Instruments Inc., Chiba-shi, Chiba (JP)

(72) Inventors: Haruki Hiranuma, Chiba (JP); Masahiro Ishida, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/845,002

(22) Filed: Sep. 3, 2015

(65) Prior Publication Data

US 2016/0070232 A1 Mar. 10, 2016

(30) Foreign Application Priority Data

Sep. 9, 2014 (JP) ..... 2014-183403

(51) Int. Cl.

| | |
|---|---|
| ***G04B 37/00*** | (2006.01) |
| ***G04B 29/00*** | (2006.01) |
| ***G04B 3/04*** | (2006.01) |
| ***G04B 11/00*** | (2006.01) |
| ***G04B 37/10*** | (2006.01) |

(52) U.S. Cl.

CPC ..... *G04B 3/041* (2013.01); *G04B 11/00* (2013.01); *G04B 37/10* (2013.01); *G04B 37/103* (2013.01)

(58) Field of Classification Search

CPC ..... G04B 3/041; G04B 37/10; G04B 37/103
USPC ..... 368/306–308, 319
See application file for complete search history.

(56) References Cited

U.S. PATENT DOCUMENTS 3,064,415 A * 11/1962 Polo ..... G04B 27/02 368/191
3,389,550 A * 6/1968 Piquerez ..... G04B 19/28 368/308
4,104,866 A * 8/1978 Chappatte ..... G04B 19/25 368/319
8,454,227 B2 * 6/2013 Romano ..... G04B 37/103 368/289
2002/0167866 A1 * 11/2002 Oomori ..... G04B 37/06 368/191

(Continued)

FOREIGN PATENT DOCUMENTS

FR 1602849 A * 2/1971 ..... G04B 19/28
FR WO 2011104480 A1 * 9/2011 ..... G04B 19/283

(Continued)

OTHER PUBLICATIONS

Bechet, Benoit, WO 2011104480 English Translation, document orginially published Sep. 1, 2011, full document.*

*Primary Examiner* — Amy Cohen Johnson
*Assistant Examiner* — Daniel Wicklund
(74) *Attorney, Agent, or Firm* — Brinks Gilson & Lione

(57) ABSTRACT

The present invention improves the weathering performance of a stopper structure preventing inadvertent rotation or a rotated body accommodated in a case. An operation member having a head portion rotated outside the case and a shaft portion inserted into a pipe so as to be movable between a first position and a second position that is outer than the first position. A stopper structure is provided inside the case to prevent rotation of the head portion when the operation member is positioned at the second position, whereas the stopper structure allows rotation of the head portion when the operation member is positioned at the first position.

8 Claims, 6 Drawing Sheets

(56) References Cited

U.S. PATENT DOCUMENTS

| | | | | |
|---|---|---|---|---|
| 2005/0162985 | A1* | 7/2005 | Speichinger | G04B 3/041 368/319 |
| 2015/0023142 | A1* | 1/2015 | Breuillot | G04B 37/103 368/290 |
| 2015/0117163 | A1* | 4/2015 | Speichinger | G04B 3/041 368/185 |

FOREIGN PATENT DOCUMENTS

| | | | | |
|---|---|---|---|---|
| FR | 2987684 | A1 * | 9/2013 | G04B 19/283 |
| JP | 2010-139399 | A | 6/2010 | |
| JP | 2011-185835 | A | 9/2011 | |

* cited by examiner

TIMEPIECE

RELATED APPLICATIONS

This application claims priority under 35 U.S.C. §119 to Japanese Patent Application No. 2014-183403 filed on Sep. 9, 2014, the entire content of which is hereby incorporated by reference.

BACKGROUND OF THE INVENTION

1. Field of the Invention

The present invention relates to a timepiece such as a portable timepiece which has within a case a rotated body to be rotated through operation outside the case constituting the exterior member and which has a stopper means preventing inadvertent rotation of this rotated body.

2. Description of the Related Art

Conventionally, there has been know a timepiece in which some measures are taken to prevent a malfunction of an in-revolving ring arranged so as to be rotatable along the peripheral edge of a dial within an exterior case, that is, inadvertent rotation of the in-revolving ring while, for example, the timepiece is being carried about (See, for example, Patent Literature 1 (JP-A-2010-139399)).

In the timepiece disclosed in Patent Literature 1, the case band of the case is provided with an engagement/disengagement means which, as an operation member moves, is engaged with or disengaged from an in-case end portion (hereinafter referred to as the inner end portion) of a pipe extending through the case band and fixed in position, and an in-revolving ring within the case. The operation member can be pushed and drawn with the head portion thereof pinched, and is urged toward the exterior of the case by a coil spring.

The engagement/disengagement means is composed of a drive transmission gear having teeth radially protruding from the outer periphery of the inner end portion of the pipe, and a drive gear which is formed on the back surface of the in-revolving ring and with and from which the drive transmission gear is engaged and disengaged through axial movement of a rotational operation portion.

In the timepiece disclosed in Patent Literature 1, in the state other than during the rotation of the in-revolving ring, the drive gear is separated from the drive transmission gear, so that inadvertent rotation of the operation member is not transmitted to the in-revolving ring. However, in the state in which the operation member is pushed toward the exterior of the case by the coil spring, it is possible to intentionally rotate the operation member; in this case, the operation member only idles, and cannot conjunction-move the in-revolving ring, so that there is a fear of the user thinking something is wrong with the timepiece.

Further, when a shock is applied to the timepiece, it is difficult to correctly maintain the still state of the in-revolving ring, so that, in rotating the in-revolving ring, when the user pushes in the operation member to bring the drive gear into mesh with the drive transmission gear, there is a fear of the drive gear hitting an end portion of the drive transmission gear, causing defective mesh-engagement between the drive gear and the drive transmission gear.

In this connection, there is known a timepiece with a stopper means which, while constantly maintaining the mesh-engagement between the drive gear and the drive transmission gear, prevents inadvertent rotation of the in-revolving ring and idling of the operation member when, for example, the timepiece is being carried about (See, for example, Patent Literature 2 (JP-A-2011-185835)).

In the timepiece of Patent Literature 2, the end portion situated outside the case (hereinafter referred to as the outer end portion) of a pipe extending through the case band of the case and fixed in position, and the head portion of an operation member inserted into the pipe, are provided with a stopper means engaged and disengaged as the operation member moves. The operation member allows rotation and pushing and drawing with its head portion being held, and is urged in the axial direction by a spring member. A drive gear is fixed to the shaft portion of the operation member, and this gear constantly maintains a state in which it is in mesh with tooth portions of an in-revolving ring in the case. Thus, through the rotation of the operation member, it is possible to rotate the drive gear.

In Patent Literature 2, the stopper means is arranged outside the case, and this means is composed of a lock gear having outer teeth radially protruding from the outer periphery of the outer end portion of the pipe, and an engagement ring mounted to the inner peripheral surface of the head portion of the operation member. The engagement ring has inner teeth engaged and disengaged with and from the outer teeth of the lock gear. Normally, due to the urging force of the spring member, the operation member is arranged at a first position where the outer teeth and the inner teeth are engaged (in mesh) with each other, whereby inadvertent rotation of the operation member is prevented. By axially moving the operation member against the urging force of the spring member to a second position where the outer teeth and the inner teeth are disengaged from each other, it is possible to rotate the operation member.

In a timepiece in which the stopper means is arranged outside the case as described above, the stopper means is rather poor in weathering performance, so that this means is easily exposed to human sweat, wind and rain, dust, etc., which means the means is subject to corrosion. Further, the engagement ring of the stopper means is mounted to the inner side of the head portion of the operation member, so that there is a fear of the head portion being increased in diameter. An increase in the diameter of the head portion is not compatible with the promotion in the reduction in the thickness of the case. At the same time, an increase in the diameter of the head portion leads to a reduction in operational torque, whereas the head portion gets easily caught by the edge of the trouser pocket when the timepiece is being carried about, which is not desirable.

SUMMARY OF THE INVENTION

It is an object of the present invention to provide a timepiece in which it is possible to improve the weathering performance of a stopper means preventing inadvertent rotation or a rotated body accommodated in a case and idling of an operation member rotating the rotated body while, for example, the timepiece is being carried about and in which there is involved no increase in the diameter of the head portion of the operation member due to the stopper means.

To achieve the above object, there is provided, in accordance with the present invention, a timepiece including: a case having a through-hole; a rotated body having a driven gear portion and rotatably accommodated in the case; a pipe fixed to the through-hole; an operation member having a head portion for rotational operation arranged outside the case and a shaft portion rotatable with respect to the pipe and inserted so as to be movable in the direction in which the center axis of the pipe extends and configured to be moved between a first position and a second position set through positional deviation in the direction in which the center axis extends; an urging member urging the operation member such that the operation member is arranged at the second position; a drive gear mounted to an end portion of the shaft portion protruding into the case and constantly held in mesh with the driven gear portion; and a stopper means provided inside the case and preventing rotation of the head portion with the operation member being arranged at the first position and allowing rotation of the head portion for conjunction-moving the rotated body with the operation member being arranged at the second position.

In the timepiece of the present invention, the stopper means is arranged inside the case, so that the stopper means is improved in terms of weathering performance. At the same time, the stopper means does not utilize the head portion of the operation member situated outside the case, so that the head portion is not increased in diameter due to the stopper means.

And, in this timepiece, in the state other than when the rotated body is rotated, the operation member is arranged at the first position by the urging force of the urging member, and the stopper means prevents rotation of the head portion of the operation member. As a result, although the drive gear and the driven gear portion are constantly held in mesh with each other, it is possible to prevent inadvertent rotation of the rotated body and idling of the operation member. When rotating the rotated body, the head portion is pinched and pushed in to the second position. As a result, a state is attained in which the stopper means allows rotation of the operation member. In this state, as the head portion is rotated, the rotation of the operation member is transmitted to the rotated boy via the mesh-engagement between the drive gear and the driven gear portion, and a desired rotation is imparted to the rotated body.

According to a preferred mode of the timepiece of the present invention, there is provided a timepiece, wherein the stopper means includes: a tapered detent portion formed at an end portion of the pipe facing the interior of the case and protruding toward the drive gear along the direction in which the center axis extends; and an engagement portion provided on the drive gear and configured to be engaged with and disengaged from the detent portion as the operation member reciprocates between the first position and the second position.

According to this preferred mode, the detent portion is formed by utilizing the thickness of the end portion of the pipe, and does not protrude from around the periphery of the end portion of the pipe along the radial direction of the pipe. As a result, there is no need to provide a space in which the detent portion and the engagement portion are provided around the outer periphery of the end portion of the pipe. Or, even when the engagement portion is of a larger thickness than the end portion of the pipe and protrudes from the outer periphery of the end portion of the pipe, the protruding dimension is small. In accordance with this, it is possible to diminish the space that the stopper hindering erroneous operation of the rotated body in the case occupies with respect to the case thickness direction. Further, due to the tapered configuration of the detent portion, when, as the operation member is moved to the first position by the urging member, it strives to be engaged with the engagement portion and the detent portion, it is possible to suppress the engagement portion from getting caught by the detent portion in the moving direction of the operation member to the first position, making it possible to smoothly engage the engagement portion with the detent portion.

According to a preferred mode of the present invention, there is provided a timepiece, wherein the detent portion has a pair of side surfaces engaged with the engagement portion; and these side surfaces are oblique and are gradually reduced in the mutual distance.

According to this preferred mode, the tapered configuration of the detent portion is formed by a pair of oblique side surfaces gradually reduced in mutual distance. As a result, when the engagement portion strives to be engaged with the detent portion as the operation member is moved from the second position to the first position by the urging member, it is possible to suppress the engagement portion from being caught by the detent portion along the moving direction of the operation member to the first position. Thus, it is possible to smoothly engage the engagement portion with the detent portion.

According to a preferred mode of the timepiece of the present invention, there is provided a timepiece, wherein the detent portion has a pair of side surfaces engaged with the engagement portion; and these side surfaces are oblique and gradually reduced in mutual distance, with the engagement portion being tapered toward the pipe.

According to this preferred mode, the tapered configuration of the engagement portion is formed by a pair of oblique side surfaces gradually reduced in mutual distance. As a result, when, as the operation member is moved from the second position to the first position by the urging member, it strives to be engaged with the engagement portion and the detent portion, it is possible to suppress the engagement portion from being caught by the detent portion along the moving direction of the operation member to the first position. Thus, it is possible to smoothly engage the engagement portion with the detent portion.

According to a preferred mode of the timepiece of the present invention, a plurality of the detent portions are provided side by side one round in the peripheral direction of the pipe; and the same number of engagement portions as the detent portions are provided on the drive gear side by side one round in the peripheral direction of this gear.

According to this preferred mode, with the operation member arranged at the first position, a larger number of detent portions and engagement portions are engaged, so that it is possible to attain a high performance in preventing inadvertent rotation of the operation member due to the stopper means.

Further, there is a fear of an excessive rotational operation force being applied by the user to the head portion of the operation member arranged at the first position. In this case, as the operation member is moved toward the second position, the oblique engagement surfaces of the detent portion and the engagement portion in contact with each other change their relative positions while generating slippage between them, and, as a result of the progress thereof, the engagement portion is detached from the detent portion. Thus, there is no fear of an excessive stress being applied to the detent portion and the engagement portion to damage them.

At the same time, immediately after the engagement portion is detached from the detent portion, the operation member is moved toward the first position by the urging member, and the engagement portion is engaged with the detent portion. As a result, it is possible to give a tactile feel to the operator, so that it is possible to perceive an erroneous operation on the operation member arranged at the first position.

According to a preferred mode of the timepiece of the present invention, the engagement portion is integral with the drive gear.

According to this preferred mode, as described above, the detent portion is formed by utilizing the end portion of the pipe; in addition, there is no need for a component for providing the engagement portion. Thus, it is possible to form the stopper means without involving an increase in the number of components.

According to a preferred mode of the timepiece of the present invention, the engagement portion protrudes from a side surface of the drive gear.

According to this preferred mode, it is possible to reduce the diameter of the drive gear. That is, the engagement portion protrudes from a side surface of the drive gear, whereby, in engaging the engagement portion with the detent portion at the first position, there is no need for a portion to be provided on the drive gear which is fit-engaged with the outer periphery of the end portion of the pipe, so that it is possible to reduce the diameter of the drive gear. Thus, the arrangement space for the drive gear in the case with respect to the case thickness direction is advantageously small.

According to a preferred mode of the timepiece of the present invention, a disc-like dial is accommodated in the case; and the rotated body is a ring-like display body arranged so as to be rotatable along the outer peripheral edge of the dial.

According to this preferred mode, inadvertent rotation of the operation member pushed by the urging member as described above and arranged at the first position is prevented by the stopper means. As a result, it is possible to suppress erroneous operation of the display body rotated in the case in conjunction with the rotation of the operation member. Thus, it is possible to suppress inadvertent disorder of the display of the display body and the display of the dial or a function determined by the relationship with the time indicating hands (e.g., timer function).

In the timepiece according to the present invention, it is possible to improve the weathering performance of the stopper means which prevents inadvertent rotation of the rotated body provided in the case while, for example, the timepiece is being carried about, and inadvertent idling of the operation member rotated outside the case to move the rotated boy in conjunction therewith while, for example, the timepiece is being carried about; at the same time, the head portion of the operation member is not increased in diameter due to the stopper means.

DETAILED DESCRIPTION OF THE PREFERRED EMBODIMENTS

The first embodiment of the present invention will be described with reference to FIGS. 1 through 6.

Figure 1:
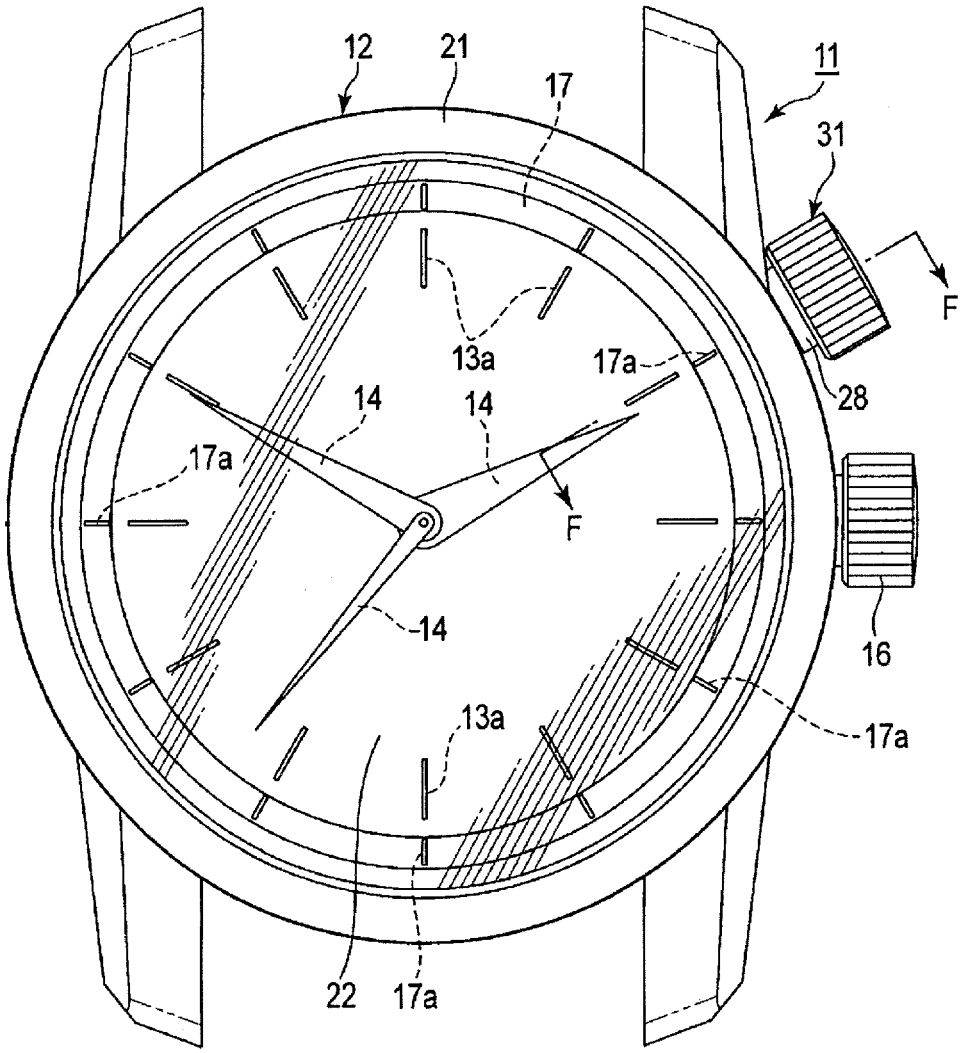
FIG. 1 is a front view of a wristwatch according to a first embodiment of the present invention.
Figure 2:
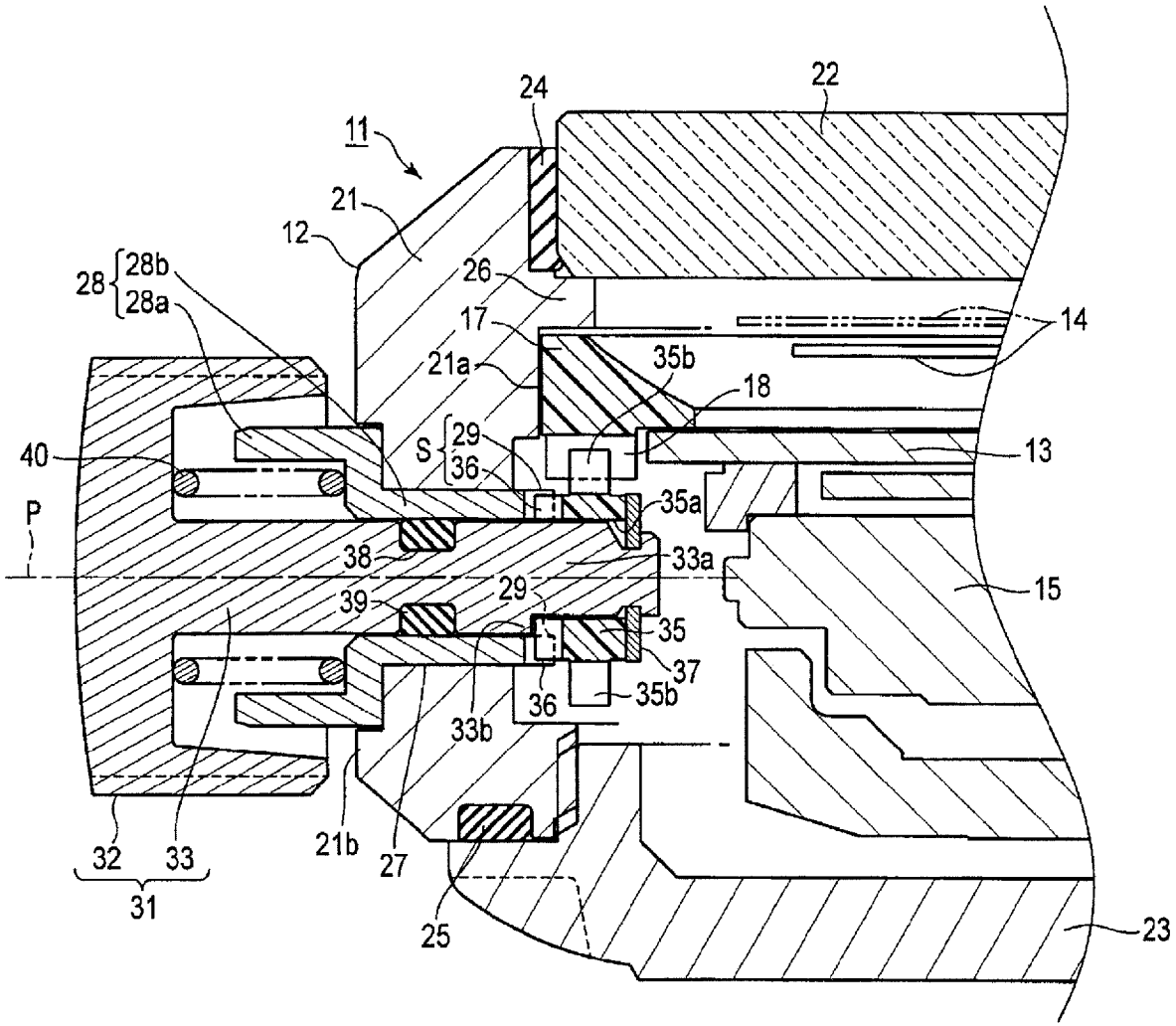
FIG. 2 is a sectional view taken along arrow line F-F of FIG. 1.
Figure 3:
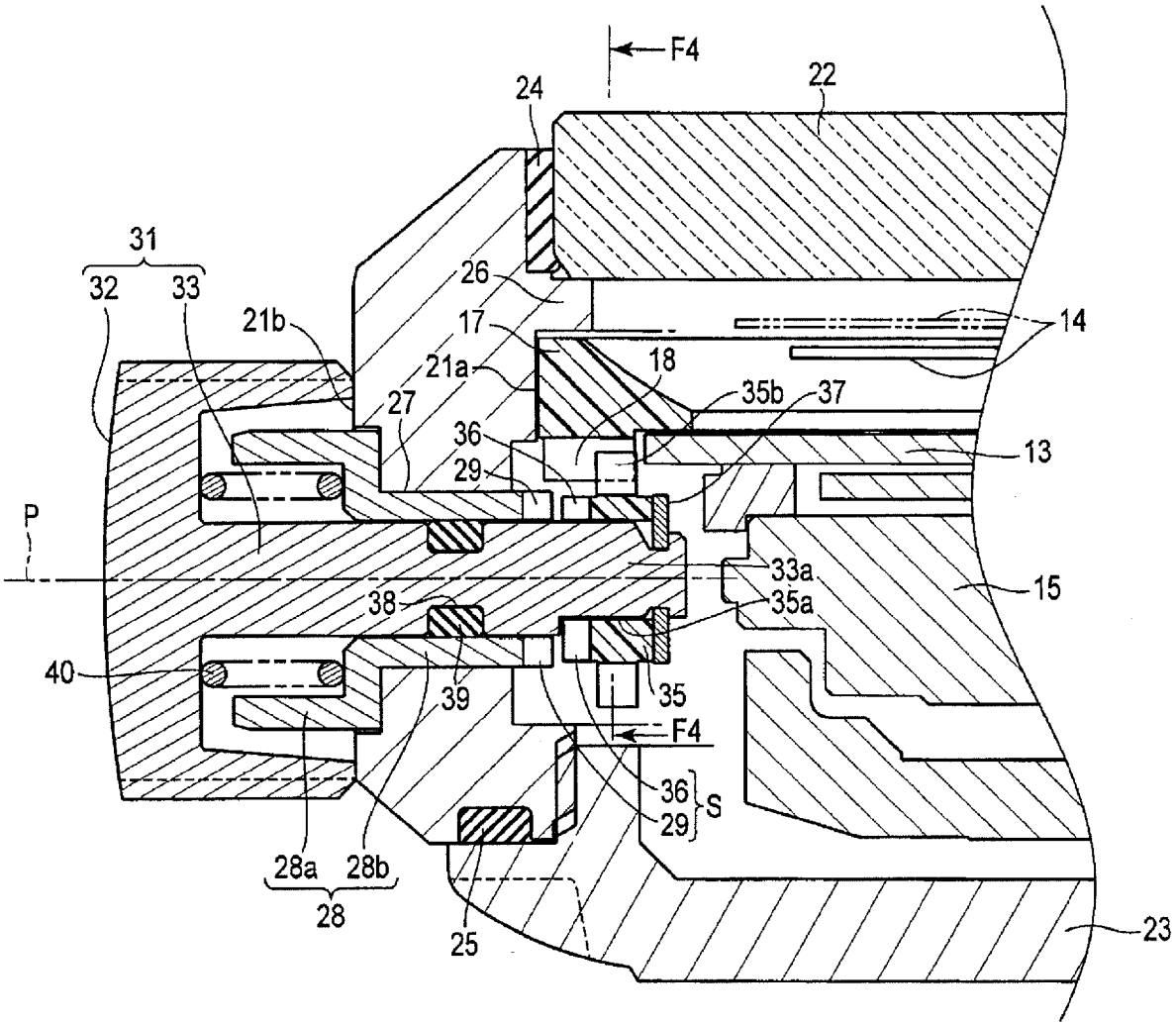
FIG. 3 is a sectional view corresponding to FIG. 2 illustrating the operation member of the wristwatch according to the first embodiment as arranged at a second position where it is rotated.

In FIGS. 1 through 3, numeral 11 indicates a timepiece such as a portable timepiece, more specifically, a waterproof wristwatch. The wristwatch 11 is equipped with a case 12 constituting the exterior member thereof.

As shown in FIGS. 2 and 3, accommodated in the case 12 are the requisite members such as a dial 13, a movement 15 controlling the movement of time indicating hands 14, and a rotated body such as a display body 17. The rotated body is not restricted to the display body 17; it is only necessary for the body to be a member rotatably accommodated in the case 12, and configured to be rotated in conjunction with operation from outside the case 12.

The dial 13 is circular, and has at is peripheral portion a time indicating scale 13*a*. The dial 13 may be a digital display type dial displaying the time display scale through a liquid crystal screen. The time indicating hands 14 consist of at least an hour hand and a minute hand of an hour hand, minute hand, and second hand.

As shown in FIG. 1, a crown 16 is mounted to the case 12 in the 3 o'clock direction of the wristwatch 11. The crown 16 is rotated outside the case 12. The rotation of the crown 16 is thereby imparted to a train wheel (not shown) of the movement 15 in order, for example, to rotate the minute hand, and the position of the minute hand is adjusted.

The display body 17 is formed, for example, of synthetic resin, and is ring-like in plan view as shown in FIG. 1. The outer diameter of the display body 17 is larger than the diameter of the dial 13, and the inner diameter of the display body 17 is smaller than the diameter of the dial 13. The display body 17 is arranged so as to be rotatable in the peripheral direction of the dial 13. As shown in FIGS. 2 and 3, the inner peripheral portion of the display body 17 overlaps the surface of the peripheral portion of the dial 13.

As shown in FIGS. 2 and 3, the thickness of the display body 17 gradually increases from the inner periphery toward the outer periphery. The oblique and annular surface of the display body 17 thereby formed is utilized as the display surface, and a display 17*a* is provided on this surface as shown in FIG. 1. The display 17*a* consists, for example, of graduations provided at equal intervals along the peripheral direction of the display body 17 by printing or the like. Through a change in the relative positions of the display 17*a* moved to a predetermined position through the rotation of the display body 17 and of the time indicating hands 14, it is possible to obtain a timer function by which a period of time that has elapsed since a predetermined time is measured.

As described above, it is desirable for the display body 17 to be of a ring-like configuration in plan view; this, however, should not be construed restrictively. In the case where the display body 17 is of a ring-like configuration in plan view, it may be of an endless configuration in plan view or of a C-shaped configuration, with its ends being opposite each other. The display 17*a* of the display body 17 is not restricted to graduations; it may also consist of a plurality of display regions divided by colors different from each other. Alternatively, the display 17*a* may consist of a plurality of plain display regions with symbols drawn therein (e.g., a sun symbol indicating the day time, and a moon symbol indicating the time after sunset). Further, instead of providing the timer function, the display 17*a* may be of a direction display enabling a simple direction measurement.

Figure 4:
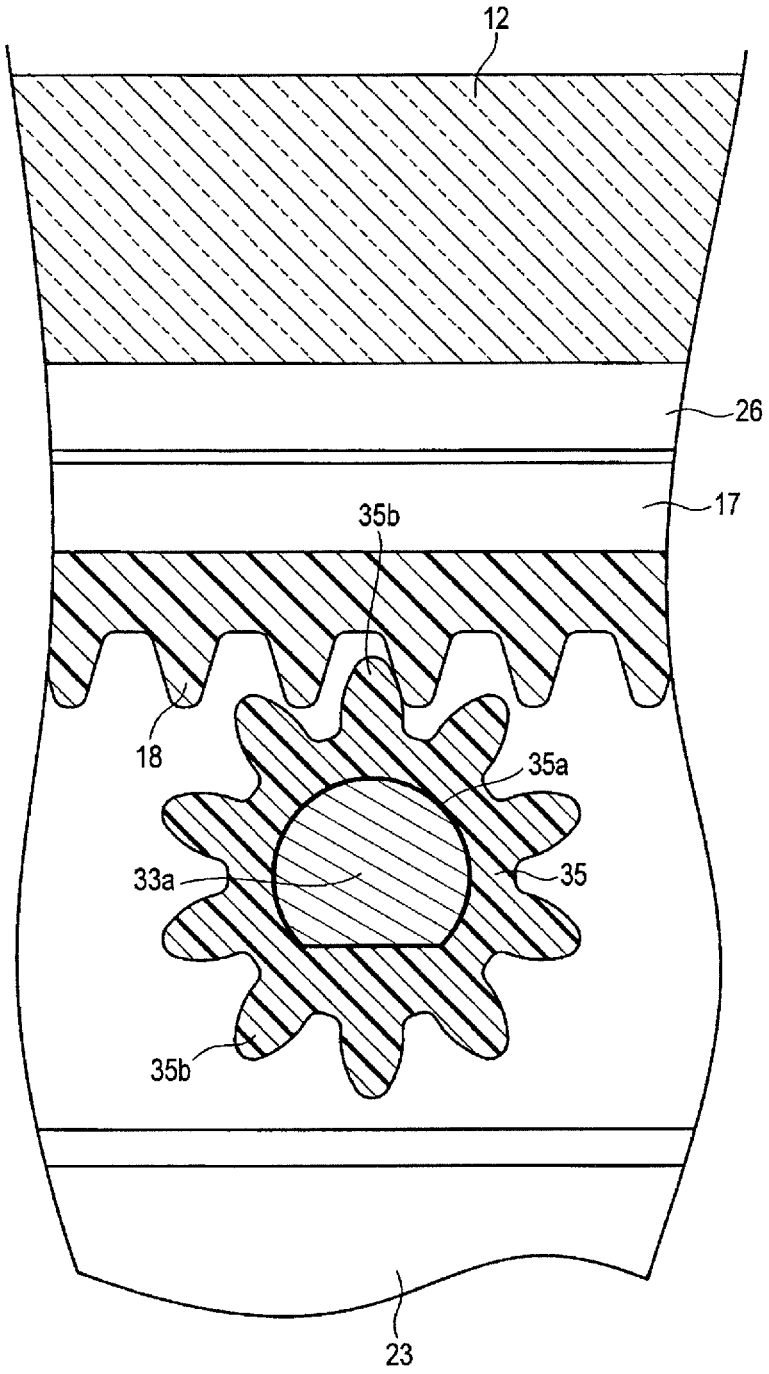
FIG. 4 is a sectional view taken along arrow line F4-F4 of FIG. 3.

As shown in FIGS. 2 through 4, the display body 17 integrally has on the back side thereof a driven gear portion 18. The driven gear portion 18 is provided with trough portions and crest portions arranged alternately in the peripheral direction of the display body 17, and the crest portions and the trough portions extend in the radial direction of the display body 17. The driven gear portion 18 is off the outer periphery of the dial 13, and surrounds this outer periphery.

As shown in FIGS. 2 and 3, the case 12 is formed by attaching, for example, a transparent cover 22 liquid-tight to one surface in the thickness direction of an annular case band 21 and attaching a case back 23 liquid-tight to the other surface in the thickness direction of the case band 21. It is desirable for the case band 21 to be formed of a metal such as stainless steel or titanium.

The transparent cover 22 is, for example, circular, and constitutes the front side of the timepiece 11. The transparent cover 22 consists of a transparent member, e.g., transparent glass; through this, it is possible to see the dial 13 and the display body 17. The case back 23 constitutes the back surface of the timepiece 11. The case back 23 is formed of metal, synthetic resin or the like. In FIGS. 2 and 3, numerals 24 and 25 respectively indicate annular seals held between the case band 21 and the transparent cover 22 and between the case band 21 and the case back 23 in order to maintain the liquid-tightness of the case 12.

As shown in FIGS. 2 and 3, the case band 21 has an annular protrusion 26 protruding toward the inner space. The back surface of the peripheral portion of the transparent cover 22 is held in contact with and supported by the annular protrusion 26. This annular protrusion 26 covers the surface of the outer peripheral portion of the display body 17. Thus, the display body 17 is retained by the dial 13 and the annular protrusion 26 so as not to move in the thickness direction of the timepiece 11. Further, the inner peripheral surface 21*a* of the case band 21 continuous at right angles with the back side of the annular protrusion 26 is close to the outer peripheral surface of the display body 17, whereby the display body 17 is retained so as not to move in the radial direction thereof.

The case band 21 has a through-hole 27 shown in FIGS. 2 and 3 at a position deviated from the mounting position of the crown 16, e.g., in the 2 o'clock direction. A pipe 28 is inserted into this through-hole 27 to be fixed to the case 12. When both the case band 21 and the pipe 28 are formed of metal, the pipe 28 is fixed to the case band 21 by brazing. When at least one of the case band 21 and the pipe 28 is formed of synthetic resin, the pipe 28 is fixed to the case band 21 by using adhesive. The pipe 28 extends in the radial direction of the display body 17.

The pipe 28 is in the form of a stepped cylinder having a large-diameter portion 28*a* and a small-diameter portion 28*b*. The small-diameter portion 28*b* of this pipe 28 is passed through the through-hole 27. The large-diameter portion 28*a* of the pipe 28 is arranged outside the case 12, with the end surface thereof nearer to the small-diameter portion 28*b* being held in contact with the outer peripheral surface of the case 12.

Figure 5:
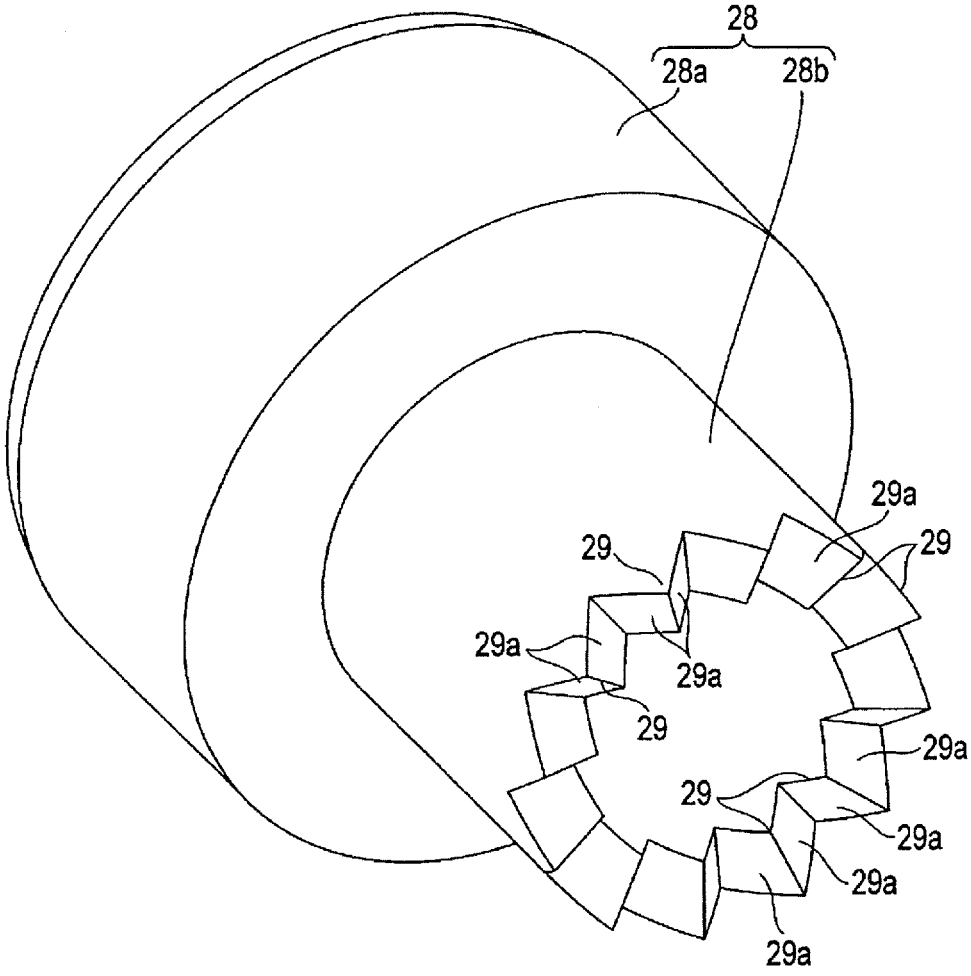
FIG. 5 is a perspective view of a pipe with which the timepiece of FIG. 1 is provided.

The end portion of the small-diameter portion 28*b* on the opposite side of the large-diameter portion 28*a* protrudes into the interior of the case 12. A detent portion 29 is formed at the end portion of the small-diameter portion 28*b*. In a preferred example, there are provided a plurality of the detents 29 are provided and arranged side by side one round in the peripheral direction of the pipe 28 as shown in FIG. 5.

These detent portions 29 are formed to extend along the direction in which the center axis P of the pipe 28 extends toward a drive gear described below, in other words, they protrude while tapered toward the center side of the case 12. More specifically, each detent portion 29 has a pair of oblique side surfaces 29*a*, and the distance between these side surfaces 29*a*, in other words, the width of the detent portions 29 is gradually reduced.

As a result, each detent portion 29 forms a triangular crest portion. Thus, the end portion of the small-diameter portion 28*b* facing the interior of the case 12 is of a structure in which triangular crest portions and triangular trough portions formed to be adjacent thereto in the peripheral direction of the pipe 28 are provided alternately in the peripheral direction of the pipe 28.

In the case where the pipe 28 is formed of metal, machining is performed so as to leave cutting marks corresponding to the trough portions at the end portion of the small-diameter portion 28*b*. As a result, the detent portions 29 are formed between the cutting marks adjacent in the peripheral direction of the pipe 28. In forming the detent portions 29 through machining on the pipe 28, the pipe 28 itself does not restrict the operating space, and the space around the pipe 28 constitutes the operating space, resulting in satisfactory machinability. When the pipe 28 is formed of synthetic resin, the detent portions 29 are formed through the molding of this pipe 28.

So long as it is tapered, the configuration of the detent portions 29 is not restricted to the triangular one; for example, the apexes of the triangles may be rounded or the detent portions may be formed as isosceles trapezoids; further, when the rotational direction of the operation member described below is one direction, only one side surface of each detent portion 29 may be formed obliquely to be thereby tapered.

In FIG. 1, numeral 31 indicates an operation member. The operation member 31 is operated outside the case 12 in order to move the display 17*a*; it conjunction-moves the display body 17, and, the display body 17 is rotated through this conjunction movement. As shown in FIGS. 2 and 3, the operation member 31 is preferably formed of metal, and is equipped with a head portion 32 and a shaft portion 33.

The head portion 32 is formed as a cap having a ring-like peripheral wall and an end wall closing one end of this peripheral wall. The depth and the inner diameter (the diameter formed by the inner peripheral surface of the peripheral wall) of this head 32 are larger than the entire length of the large-diameter portion 28*a* of the pipe 28 and the diameter formed by the outer peripheral surface of the large-diameter portion 28*a*. A knurled portion for preventing slipping of the fingers of the operator when this head portion 32 is rotated is provided on the outer peripheral surface of the peripheral wall of the head portion 32 through knurling.

The shaft portion 33 integrally protrudes from the central portion of the back surface of the end wall of the head portion 32, and this shaft portion 33 is longer than the entire length of the large-diameter portion 28*a*. The sectional configuration of the distal end portion 33*a* of the shaft portion 33 in the direction orthogonal to the axial direction of the shaft portion 33 is non-circular, e.g., a D-shaped section as shown in FIG. 4. As a result, the shaft portion 33 has a step 33*b*.

The diameter of the outer peripheral surface of the portion other than the distal end portion 33*a*, that is, the diameter of the portion from the root of the shaft portion 33 to the distal end portion 33*a* is fixed and is slightly smaller than the inner diameter of the small-diameter portion 28*b* of the pipe 28. The above-mentioned portion is longer than the entire length of the pipe 28.

The shaft portion 33 of the operation member 31 is rotatable with respect to the pipe 28 and is inserted so as to be movable in the axial direction of the pipe 28 (i.e., in the direction in which the center axis P of the pipe 28 extends. As a result, the head portion 32 of the operation member 31 is arranged outside the case 12 while covering the large-diameter portion 28*a* of the pipe 28.

Mounted to the distal end portion 33*a* of the shaft portion 33 is a drive gear 35 transmitting the rotation of the operation member 31 to the display body 17. More specifically, the drive gear 35 has a fit-engagement hole 35*a* of a configuration corresponding to the sectional configuration of the distal end portion 33*a*. After fit-engaging this fit-engagement hole 35*a* with the distal end portion 33*a*, there is mounted a snap ring 37 to a groove open in the outer peripheral surface of the distal end portion 33*a*, whereby the drive gear 35 is held between the snap ring 37 and the step 33*b*, and the distal end portion 33*a* is mounted so as to be prevented from rotating with respect to the distal end portion 33*a*. Teeth 35*b* that the drive gear 35 has are constantly kept in mesh with the driven gear portion 18 of the display body 17. That is, with the pushing and releasing operation of the operation member 31 described below, the position where the drive gear 35 and the driven gear portion 18 are in mesh with each other in the case 12 moves in the radial direction of the display body 17; the mesh-engagement itself, however, is maintained.

The drive gear 35 is provided with an engagement portion 36. The engagement portion 36 is engaged with and disengaged from the detent portions 29 as the operation member 31 is reciprocated in the direction in which the center axis P extends. In a preferred example, the engagement portion 36 protrudes from a side surface of the drive gear 35. In order that the engagement portion 36 may not protrude from the side surface of the drive gear 35, it is possible to provide a circular recess at the central portion of the drive gear 35, with the engagement portion 36 protruding from the bottom surface thereof.

Together with the detent portions 29, the engagement portion 36 forms a stopper means S arranged inside the case 12. Due to this stopper means S, the rotation of the head portion 32 is hindered in the state in which the operation member 31 is arranged at a first position described below, and the rotation of the head portion 32 for conjunction-moving the display body 17 is allowed in the state in which the operation member 31 is arranged at a second position described below.

It is desirable for the engagement portion 36 to be integral with the drive gear 35. In this case, the engagement portion 36 and the drive gear 35 can be formed as an integral metal molding formed through press work. However, in order that they may be produced at lower cost, in the present embodiment, the drive gear 35 having the engagement portion 36 is formed as an integral component through injection molding of synthetic resin such as polycarbonate or DURACON. When the drive gear 35 is formed of synthetic resin and the engagement portion 36 is formed of metal, they can be formed as an integral component through insert molding of the engagement portion 36 in the drive gear 35.

Figure 6:
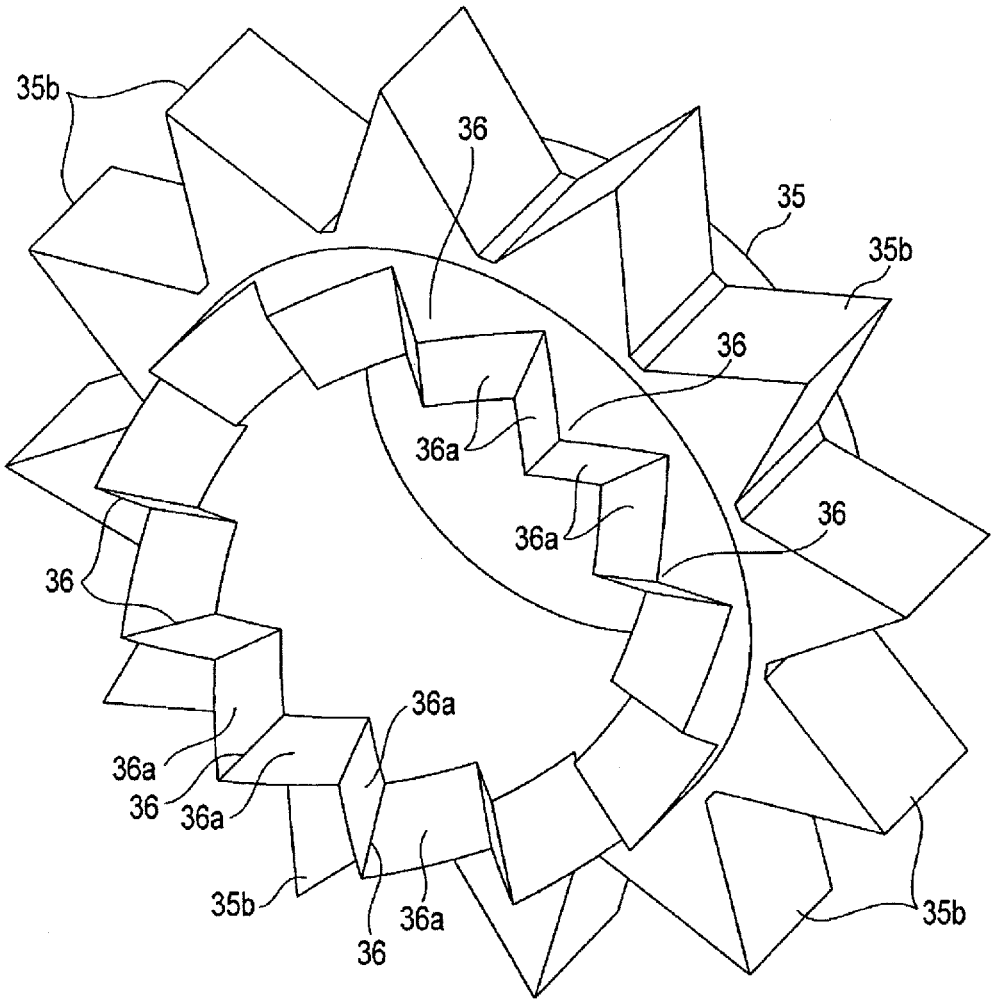
FIG. 6 is a perspective view of a drive gear with which the timepiece of FIG. 1 is provided.

As shown in FIG. 6, in a preferred example, there are provided a plurality of the engagement portions 36, more specifically, in the same number as the detent portions 29. These engagement portions 36 are arranged side by side one round in the peripheral direction of the drive gear 35.

The engagement portions 36 are tapered toward the pipe 28. More specifically, each engagement portion 36 has a pair of oblique side surfaces 36*a*, and the mutual distance between the side surfaces 36*a*, in other words, the width of the engagement portions 36 is gradually reduced.

As a result, each engagement portion 36 is in the form of a triangular crest portion. Thus, on the side surface of the drive gear 35 arranged in the case 12, there are alternately provided in the peripheral direction the triangular crest portions constituting the engagement portions 36, and triangular trough portions formed between the crest portions adjacent to the drive gear 35 in the peripheral direction. The side surfaces 36*a* of the engagement portions 36 can be engaged with and disengaged from the side surfaces 29*a* of the detent portions 29.

So long as it is tapered, the configuration of the engagement portions 36 is not restricted to the triangular one; for example, the apexes of the triangles may be rounded or the detent portions may be formed as isosceles trapezoids; further, when the rotational direction of the operation member 31 is one direction, only one side surface of each engagement portion 36 may be formed obliquely to be thereby tapered.

The shaft portion 33 of the operation member 31 has at its intermediate portion in the longitudinal direction an annular mounting groove 38 continuous in the peripheral direction. While fit-engaged with this mounting groove 38, a ring-like packing 39 is mounted so as to protrude from the outer peripheral surface of the shaft portion 33. The packing 39 is formed of a material capable of elastic deformation such as synthetic rubber or synthetic resin. This packing 39 is held between the pipe 28 and the shaft portion 33 inserted into the same while elastically deformed. As a result, the packing 39 effects waterproofing between the pipe 28 and the shaft portion 33.

The operation member 31 can move between a first position and a second position by being moved in the direction in which the center axis P of the pipe 28 extends. The first position and the second position are set so as to be deviated in the direction in which extends the center axis P of the pipe 28 extending in the radial direction of the display body 17. Normally, the operation member 31 is arranged at the first position shown in FIG. 2, and the operation member 31 pushed-in is arranged at the second position shown in FIG. 3.

The first position is the position of retaining the operation member 31 and the display body 17 so that they may not be inadvertently rotated. The second position is the position where the user or the like intentionally rotates the head portion of the operation member 31 to conjunction-move and rotate the display body 17.

The operation member 31 is retained at the first position while urged toward the exterior of the case 12 by an urging member, e.g., a coil spring 40. The coil spring 40 is held in a compressed state between the wall portion constituting the boundary between, e.g., the large-diameter portion 28*a* and the small-diameter portion 28*b*, and the end wall of the head portion 32. The arrangement of the coil spring 40 is not restricted to that described above. For example, it is also possible to hold the coil spring 40 in a compressed state between the end surface of the pipe 28 opposite the end wall of the head portion 32 and the end wall of the head portion 32. Further, it is also possible to arrange the coil spring 40 so as to surround the outer periphery of the large-diameter portion 28*a* of the pipe 28, and to hold the coil spring 40 in a compressed state between the outer side surface 21*b* of the case band 21 and the end wall of the head portion 32.

In the timepiece 11 described above, the stopper means S is arranged in the case 12, so that the stopper means S is not exposed to human sweat, moisture in the atmosphere, dust, etc. outside the case 12. As a result, there is no fear of corrosion of the stopper means S, and it is possible to improve its weathering performance.

The stopper means S does not utilize the head portion 32 of the operation member 31 situated outside the case 12, so that the head portion 32 is not increased in diameter due to the stopper means S. Thus, it is possible to contribute to a reduction in the thickness of the case 12.

The engagement portions 36 of the stopper means S are integral with the drive gear 35, and the detent portions 29 of the stopper means S are formed by utilizing the end portion of the pipe 28 protruding into the case 12. The pipe 28 is a component supporting the operation member 31, and the drive gear 35 is a component transmitting the rotation of the operation member 31 to the display body 17. Thus, no special component is required in forming the stopper means. Thus, it is possible to form the stopper means S without involving an increase in the number of components.

Further, the detent portions 29 of the stopper means are formed by utilizing the thickness of the end portion of the pipe 28, and do not protrude from the outer periphery of the end portion of the pipe 28 along the radial direction of the pipe 28. As a result, there is no need to provide around the outer periphery of the end portion of the pipe 28 protruding into the interior of the case 12 a space in which there are provided the detent portions 29 and the engagement portions 36 of the stopper means S to be engaged therewith. Or, if the engagement portions 36 is of a larger thickness than the end portion of the pipe 28, and protrude from the outer periphery of the end portion of the pipe 28, the protruding dimension is small. Accordingly, the space that the stopper means S preventing erroneous operation of the display body 17 in the case 12 occupies in the case 12 with respect to the thickness direction is advantageously small. Thus, the construction is suitable for the case in which the reduction in the thickness of the case 12 is promoted.

In addition, in the construction in which the engagement portions 36 protrude from the side surface of the drive gear 35, the diameter of the drive gear 35 is not increased.

That is, in the case where the engagement portions 36 are formed within the width of the drive gear 35, the drive gear 35 needs a portion to be fit-engaged with the outer periphery of the end portion of the pipe 28 on which the detent portions 29 are formed, and teeth 36*b* in mesh with the driven gear portion 18 of the display body 17 are formed on the outer side of this portion. As a result, the diameter of the drive gear 35 is increased due to the above-mentioned portion.

In contrast, by providing the engagement portions 36 to protrude from the side surface of the drive gear 35, there is no need to provide a portion on the drive gear 35 to be fit-engaged with the outer periphery of the end portion of the pipe 28, so that the drive gear 35 is not increased in diameter. Thus, the arrangement space for the drive gear 35 in the case 12 with respect to the thickness direction of the case 12 can be small, thereby contributing to a reduction in the thickness of the case 12.

In the timepiece 11 described above, in the state other than when the display body 17 is rotated, the operation member 31 is urged toward the exterior of the case 12 by the urging force of the coil spring 40, and is retained at the first position shown in FIG. 2. In this state, the plurality of engagement portions 36 protruding from the side surface of the drive gear 35 are engaged with the plurality of detent portions 29 of the pipe 28. The engagement is effected by the side surfaces 29*a* of the detent portions 29 and the side surfaces 36*a* of the engagement portions 36 coming into contact with each other in the peripheral direction of the pipe 28.

The pipe 28 is fixed to the case 12, so that as a result of the engagement (mesh-engagement in the present embodiment), the pipe 28 serves as a stopper, preventing the rotation of the drive gear 35, and the rotation of the operation member 31 to which this gear is mounted. Thus, although the drive gear 35 and the driven gear portion 18 of the display body 17 are constantly in mesh with each other, it is possible to prevent inadvertent rotation of the display body 17 and idling of the operation member 31 while, for example, the timepiece is being carried about.

In this way, inadvertent rotation of the operation member 31 arranged at the first position is prevented, and a malfunction of the display body 17 is suppressed, so that it is possible to suppress inadvertent disorder of the function (e.g., timer function) determined through the relationship between the display 17*a* of the display body 17 and the time display scale 13*a* of the dial 13 or the time indicating hands 14.

When rotating the display body 17, the head portion 32 is pinched, and the operation member 31 is pushed in to the second position shown in FIG. 3 against the coil spring 40. This pushing-in operation is stopped when the peripheral wall of the head portion 32 comes into contact with the outer side surface 21*b* of the case band 21. Through the movement of the drive gear 35 accompanying this pushing-in, the engagement portions 36 are detached from the detent portions 29.

That is, there is attained a state in which the stopper means S allows the rotation of the head portion 32 of the operation member 31, and in which the rotation of the head portion 32 is possible. Thus, with the rotation of the head portion 32, the rotation of the operation member 31 is transmitted to the display body 17 via the mesh-engagement between the drive gear 35 and the drive gear portion 18, making it possible to impart a desired rotation to the display body 17. In the present embodiment, the operation member 31 can be rotated both clockwise and counterclockwise.

When the display body 17 is thus rotated, and the fingers are released from the head portion 32, the operation member 31 is pushed back to the exterior of the case 12 by the urging force of the coil spring 40, and is arranged at the first position. With this, the stopper means S functions. That is, the engagement portions 36 are engaged with the detent portions 29, and the operation member 31 and the display member 17 are maintained in the state in which their inadvertent rotation is prevented.

As described above, the detent portions 29 are tapered toward the drive gear 35, and the engagement portions 36 are tapered toward the pipe 28. In addition, the pair of side surfaces 29*a* of the detent portions 29 and the pair of side surfaces 36*a* of the engagement portions 36 are both oblique, and the distance between the side surfaces 29*a* and the distance between the side surfaces 36*a* are respectively reduced. As a result, when the engagement portions 36 are to be engaged with the detent portions 29, it is possible to suppress the engagement portions 36 from being caught by the detent portions 29 along the moving direction of the operation member 31 to the first position. Thus, it is possible to smoothly engage the engagement portions 36 with the detent portions 29.

Further, as described above, the plurality of detent portions 29 are arranged side by side one round in the peripheral direction of the pipe 28, and the engagement portions 36 in the same number as the detent portions 29 are arranged on the drive gear 35 side by side one round in the peripheral direction of the gear. As a result, in the state in which the operation member 31 is arranged at the first position, more detent portions 29 and more engagement portions 36 are engaged with each other, so that the stopper means S exerts high performance in preventing inadvertent rotation of the operation member.

Further, an excessive operation force to rotate may be erroneously applied to the head portion 32 of the operation member 31 arranged at the first position. In this case, the operation member 31 is moved toward the center of the case 12 while generating slippage between the oblique side surfaces 29*a* of the detent portions 29 and the oblique side surfaces 36*a* of the engagement portions 36 held in contact with each other. With this, the engagement portions 36 are detached from the detent portions 29, so that there is no fear of excessive stress being applied to the detent portions 29 and the engagement portions 36 constituting the stopper means S to damage the same.

At the same time, immediately after the engagement portions 36 are detached from the detent portions 29, the operation member 31 is moved toward the exterior of the case 12 by the coil spring 40, and, with this, the engagement portions 36 are engaged with the detent portions 29. With this, a tactile feel is imparted to the operator. Thus, erroneous operation of the operation member 31 can be perceived.

As described above, according to the first embodiment, it is possible to provide a timepiece 11 in which it is possible to improve the weathering performance of the stopper means S preventing inadvertent rotation of the display body 17 in the case 12 while, for example, the timepiece is being carried about, and inadvertent idling of the operation member 31 conjunction-moving the display body 17 through rotational operation outside the case 12, and in which the head portion 32 of the operation member 31 is not increased due to the stopper means S.

What is claimed is:

1. A timepiece comprising:

a case having a through-hole formed therein in a first direction;

a rotatable body having a driven gear portion and rotatably accommodated in the case;

a pipe fixed in the through-hole and having an inner end surface at an inner end of the pipe located inside the case, the inner end surface being configured to form a first part of stopper structure facing towards inside the case in the first direction;

an operation member having a head arranged outside the case for rotational operation and a shaft being inserted in the pipe for rotation, the shaft having an inner end portion protruding out from the inner end surface of the pipe towards inside the case in the first direction, the shaft being movable inside the pipe in the first direction to position the operation member between a first position and a second position located outer than the first positon in the first direction;

an urging member arranged inside the case and configured to urge the operation member towards the second position;

a drive gear fixedly mounted to the inner end portion of the shaft and constantly held in mesh with the driven gear portion; and a second part of the stopper structure fixedly provided to the inner end portion of the shaft inside the case, the second part of stopper structure facing outside the case in the first direction and kept engaged with the first part of stopper structure formed in the inner end surface of the pipe, when the operation member is positioned at the second position, to thereby prevent rotation of the head portion of the operation member, whereas when the operation member is positioned at the first position against the urging member, the second part of stopper structure is disengaged from the first part of stopper structure to allow rotation of the head portion of the operation member.

2. The timepiece according to claim 1, wherein the first part of stopper structure includes at least one tapered detent formed in the inner end surface of the pipe, and the second part of stopper structure includes at least one tapered projection formed in an outer end surface of the drive gear facing towards outside the case in the first direction and configured to be engaged with and disengaged from the at least one tapered detent of the first part of stopper structure as the operation member reciprocates between the first position and the second position.

3. The timepiece according to claim 2, wherein the at least one tapered detent of the first part of stopper structure has a pair of side oblique surfaces a distance between which reduces towards outside the case in the first direction.

4. The timepiece according to claim 2, wherein the at least one tapered projection of the second part of stopper structure has a pair of side oblique surfaces a distance between with reduces towards outside the case in the first direction.

5. The timepiece according to claim 4, wherein a plurality of the tapered detents are provided in series in the inner end surface of the pipe in a circumferential direction of the pipe, and a plurality of the tapered projections are provided in series in the same number as the tapered detents in the outer end surface of the drive gear in the circumferential direction of the pipe.

6. The timepiece according to claim 5, wherein the second part of stopper structure is formed integral with the drive gear.

7. The timepiece according to claim 6, wherein the plurality of tapered projections protrude from the outer end surface of the drive gear.

8. The timepiece according to claim 1, further comprising a disc-like dial accommodated in the case, and the rotatable body is a ring-like display body arranged for rotation along an outer peripheral edge of the disc-like dial.

* * * * *